US005961057A

United States Patent [19]

Turner

[11] Patent Number: 5,961,057

[45] Date of Patent: Oct. 5, 1999

[54] WOOD CHIPPING MACHINES

[75] Inventor: Anthony L. Turner, Alcester, United Kingdom

[73] Assignee: Turner Developments Ltd, Warwickshire, United Kingdom

[21] Appl. No.: 08/912,085

[22] Filed: Aug. 15, 1997

[30] Foreign Application Priority Data

Aug. 20, 1996 [GB] United Kingdom ..... 9617458

[51] Int. Cl.[6] ..... B02C 18/06

[52] U.S. Cl. ..... 241/92; 144/176; 241/296

[58] Field of Search ..... 144/176; 241/296, 241/298, 278.1, 92, 243

[56] References Cited

U.S. PATENT DOCUMENTS

| | | | |
|---|---|---|---|
| 4,463,907 | 8/1984 | Biersack | 241/92 |
| 4,669,516 | 6/1987 | Carpenter et al. | 241/92 |
| 5,211,688 | 5/1993 | Rice | 241/92 |

*Primary Examiner*—Mark Rosenbaum
*Attorney, Agent, or Firm*—Marshall & Melhorn

[57] ABSTRACT

A wood-chipping machine (FIG. 1) has a plurality of cutters carried by a flywheel which is rotated to move the cutters across a throat through which material to be chipped is fed, and in which each cutter is substantially frust-conical and hence circular and a plurality of such cutters form a blade at a generally radial location of the flywheel. These facilitate blade replacement in the event of wear eg by adjusting the worn cutter angularly.

1 Claim, 3 Drawing Sheets

WOOD CHIPPING MACHINES

This invention relates to machines for making chips from brushwood and the like. These are used by tree surgeons, contractors, and public authorities to clear waste timber and turn it into a particulate material useful for mulchin,g compost production and possibly, also as a material for making wood-based products such as chip-board.

The industry standard machine has a feed roller or rollers provided with teeth to grip and embed in the branches, small diameter logs, twigs and the like, and feed these through a throat to meet a flywheel generally normally and at a radial position relative to its centre. The flywheel is massive, because of the requirements and carries cutter blades on one face at a plurality of radial locations, typically three, each of which is a straight blade which has its cutting edge extending parallel to an individual radius of the flywheel and of a length corresponding to a particular dimension of the throat. One edge of the throat provides a second cutting edge. As each blade moves over the throat and across the second cutting edge, the end of the fed material which projects beyond that edge is impacted by the blade and chopped off. Because of the nature of the material with a grain structure, a large area, as of a log, is fractured into a large number of chips. Small cross-sectional areas such as twigs may form only a single chip with each cutting stroke.

The flywheel may rotate at a high speed of the order of hundreds or thousands of RPM, and there is considerable noise from the cutters operation as well as from the driving source. The blade life is relatively short between each re-sharpening operation or replacement, due to ordinary wear and tear, and to foreign bodies which tend to be fed in, e.g. stones or grit. In ordinary operations, a chipper run more-or-less continuously during working shifts may need sharpening every say 15–30 hours, and can be re-sharpened a limited number of times.

The object of the invention is to provide improvements, particularly in shortening down time when sharpening is called for; in reducing cost of resharpening, and the cost of replacement blades. Supplementary objects include reducing noise, and reducing power requirements.

According to the invention, a chip-making machine has blades at a plurality of generally radial positions on a flywheel and is characterised by each blade consisting of one or more individual cutters arranged so as to be angularly adjustable whereby different positions of the periphery of each cutter may be successively moved into operative position.

Preferably a series of circular cutters is arranged along a line containing the axis of all of the plurality, possibly but not essentially with all of the cutters in point-to-point contact one with the next. However, square, or other polygonal cutters could be used in similar manner, preferably adjusted so that their combined operative edges do not form a straight line.

The present inventor has discovered that the industry standard machine has the effect of displacing the fed material laterally of the throat in the direction from the centre of the disc to the periphery. This results in increased wear at the outer end of each of the straight-edge cutter blades used in this prior art, and perhaps increased power requirement because of less favourable mechanical advantage.

In contrast, the invention may use blades having their axes distributed along the length of an arc (ie the line containing the axes is not straight), which may include the flywheel centre, but which has the effect of displacing the fed material inwardly towards the axis of the flywheel. This important feature of the invention is believed to result in reduced power requirements because of improved mechanical advantage. An experimental machine according to the invention is substantially less noisy than existing prior art machines, possible due to the same feature.

A saving in blade sharpening is possible, using a plurality of cutters to correspond to each of the straight cutter blades in the prior art, because the cutter nearest the flywheel axis which performs most of the cutting, due to the feature explained above, can be re-sharpened, or if necessary replaced without it being necessary to replace or resharpen the others. The same effect was not true in the prior art because the single blade had to be removed, and because sharpening had to be done in a jig, the whole of the length of the cutting edge had to be treated even if damage was limited to one end section.

However, it is preferred to arrange circular cutters so that each has a minor portion of its periphery exposed for cutting. Using three circular cutters in each group, i.e. to constitute the equivalent of each single straight cutter blade in the prior art (although not, or not necessarily having their axes on a straight line) effectively 120 degrees of each circular cutter may be effective. Hence, each cutter has three portions which can be used in turn, before any re-sharpening is necessary.

The cutters may each be made integral with a large diameter hub, received in a corresponding mounting socket on the flywheel, so that stresses are taken by the hub/socket engagement. Each blade may be held in position by a corresponding bolt. When blade edge replacement is necessary, the cutters may be loosened, and turned angularly to present a fresh portion of the cutting edge for use; it will be appreciated that re-sharpening is only necessary after the whole periphery has become worn. Moreover, if one cutter wears more rapidly, it may be adjusted or replaced without having to adjust or replace the unworn ones. It is believed that this feature will substantially reduce down-time, and sharpening and blade replacement costs.

Another aspect of the use of a plurality of circular cutting blades, which together form a group for moving as one over the throat of the machine, is that they combine to provide an edge which may be sinuous, instead of a straight line, and moreover which can be effectively continuous (if the discs touch each other) or discontinuous (if spaced further apart) and it is thought that these factors contribute to produce a slicing action rather than a chopping action; this has some effect on power requirement, noise, and perhaps also on blade wear.

The machine according to the present invention may be conventional in all respects except that of using the novel cutter blades arrangement.

One presently preferred embodiment of the invention is now more particularly described with reference to the accompanying drawings wherein.

Figure 1:
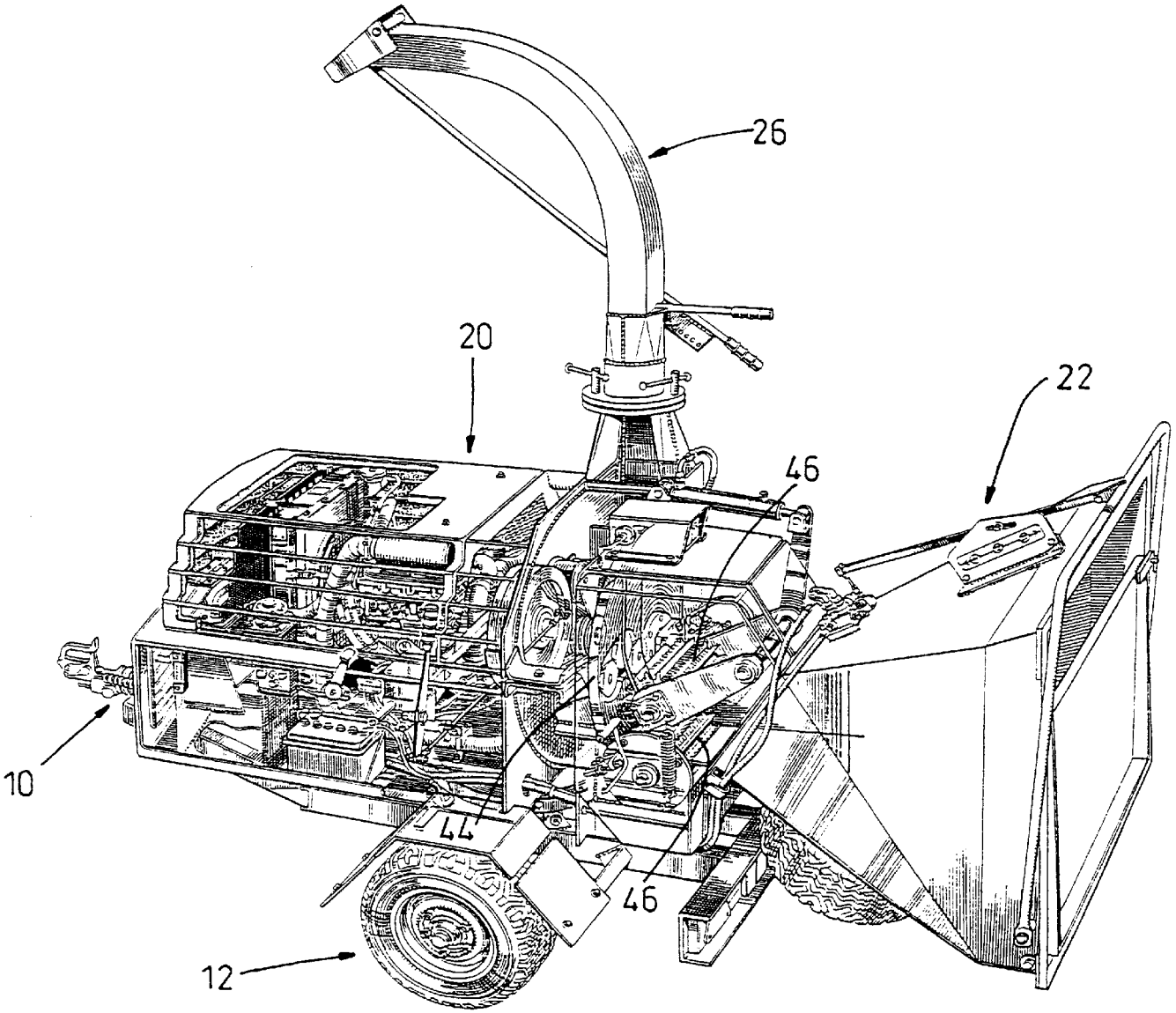
FIG. 1 is a somewhat diagrammatic and cutaway perspective illustration of a combined machine for chipping and shredding.
Figure 3:
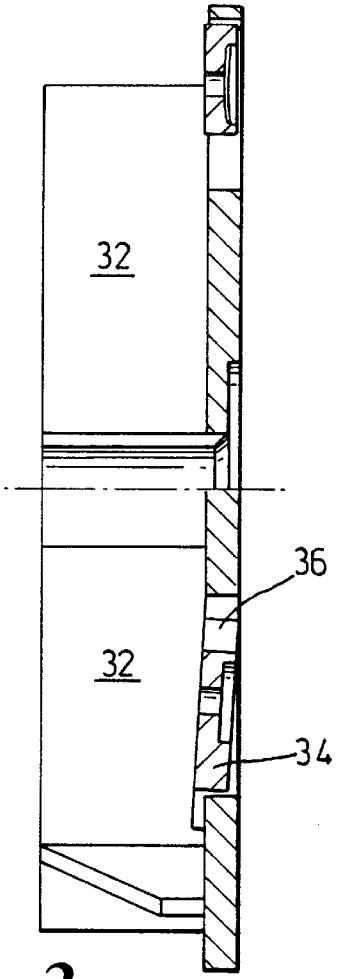
FIG. 3 is a side view of the disc shown in FIG. 2.

Turning first to FIG. 1, the machine may be portable, that is to say generally arranged as a trailer to be towed by a motor vehicle by means of a towing hitch 10 and supported by a pair of wheels 12.

The trailer supports an engine 20 with associated fuel tank coolant reservoir and like accessories. The engine drives a main shaft not clearly seen in FIG. 1.

The machine has a supply hopper 22, for material to be chipped. Chipped material is to be delivered through the outlet pipe 26 which can be swivelled to an appropriate angle according to the location of a skip or other receptacle for the chips.

Figure 2:
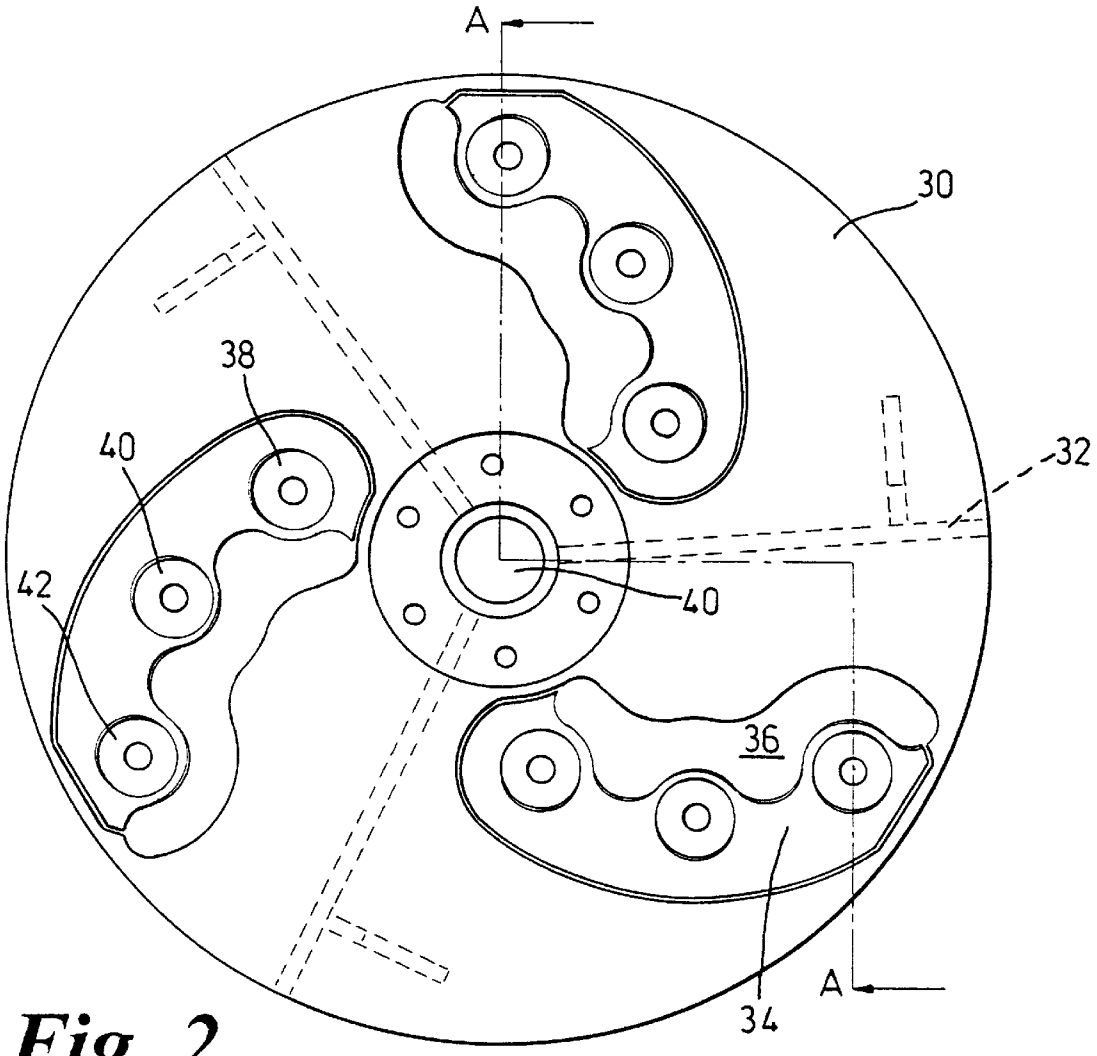
FIG. 2 is an elevation of the cutting disk used in the machine of FIG. 1, on an enlarged scale.

Turning next to FIG. 2, the flywheel 30 is made of thick steel plate and reinforced by a number of radially extended webs 32 which have the additional function of providing an air draught for carrying chipped material through the casing of the machine and through the delivery tube 26.

The flywheel is, in this embodiment, provided with the sets of cutters which are equispaced in the interests of balance of the rotating mass afforded by the flywheel 30 and the cutters. Each set comprises a carrier pad 34 which may be for example welded to the flywheel 30 about its periphery, and located closely adjacent to a correspondence aperture 36 in the flywheel. In this instance, three cutters 38, 40, 42 are provided in each set, the cutters being supported on the corresponding pad by bolts (not shown) extending through the pad and locked in place with the corresponding nuts.

Figure 4:
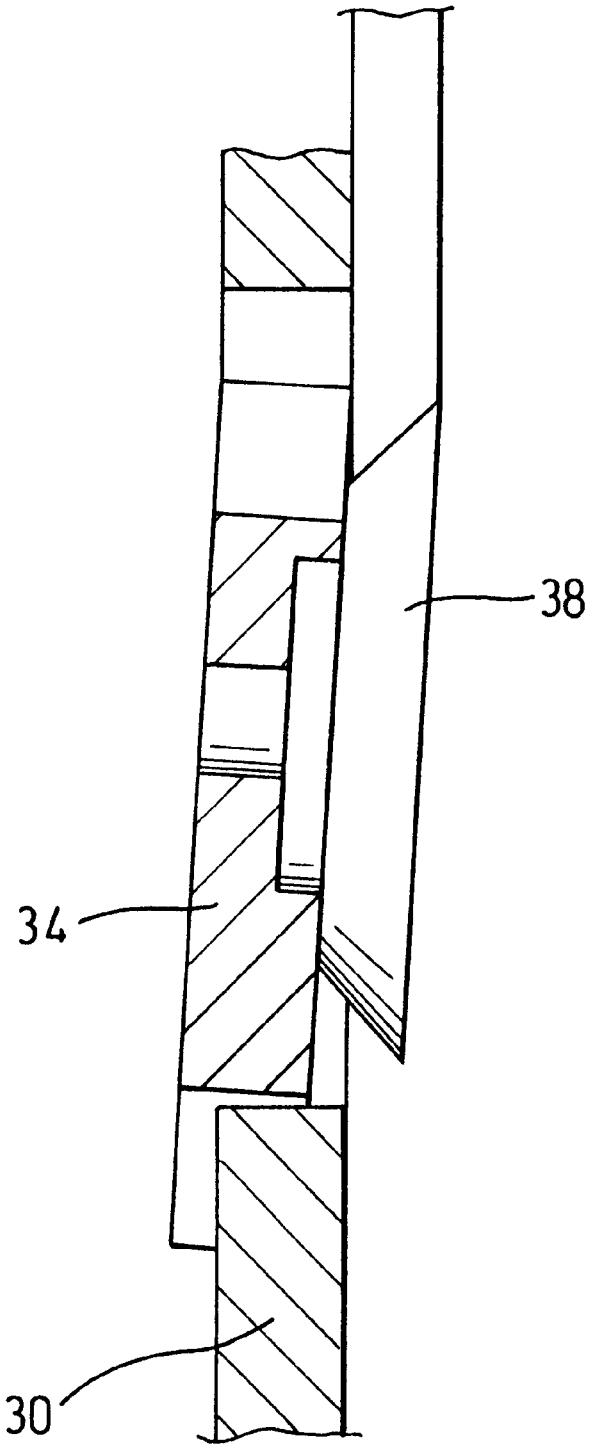
FIG.4 is an enlarged scale sectional view showing one cutter.

Each cutter in this embodiment is frusto-conical in shape with the larger diameter of the frusto-cone lying in a plane approximately parallel to the face of the pad and forming a cutting edge. However, the pad is preferably inclined to a radius of the flywheel at a small angle, typically 3 degrees, as shown in FIG. 4.

The flywheel 30 is supported on drive shaft 40 for rotation so as to take the cutters in turn past a throat (aperture) in a stationary plate 44 which is generally parallel to the plane of the flywheel forming part of the housing in which the flywheel rotates.

A pair of spiked or similar drive rollers 46 (FIG. 1) are used to feed brushwood so that it passes through the throat and is impacted by the cutters to form chips, which are carried by the draught of air, created by the rotating vanes 32, out of the machine.

I claim:

1. A chip making machine having blades at a plurality of generally radial positions on a cutting disc characterized by each blade consisting of at least two circular cutters, so as to be angularly adjustable, whereby different portions of the periphery of each cutter may be successively moved into operation position, and wherein a series of two or more of said circular cutters is arranged along a line, all of the cutters in the series being in point-to-point contact one with the next, at least three cutters being arranged so that their axes lie on an arcuate line containing the center of the cutting disc.

* * * * *